United States Patent [19]

Tabickman et al.

[11] 4,192,505

[45] Mar. 11, 1980

[54] GAME RACKET

[75] Inventors: Maurice L. Tabickman, Bloomingdale; Douglas E. Dempsey, Palatine, both of Ill.

[73] Assignee: Pepsico, Inc., Purchase, N.Y.

[21] Appl. No.: 848,940

[22] Filed: Nov. 7, 1977

[51] Int. Cl.[2] ..... A63B 49/10

[52] U.S. Cl. ..... 273/73 C

[58] Field of Search ..... 273/73 R, 73 C, 73 D, 273/73 F, 73 G, 73 H, 73 J

[56] References Cited

U.S. PATENT DOCUMENTS

| | | | |
|---|---|---|---|
| 2,171,223 | 8/1939 | Robinson | 273/73 H |
| 2,878,020 | 3/1959 | Robinson | 273/73 F |
| 3,647,211 | 3/1972 | Doessel et al. | 273/73 C |
| 3,751,034 | 8/1973 | Portz et al. | 273/73 F X |
| 3,755,037 | 8/1973 | Erwin et al. | 273/73 F X |
| 3,787,051 | 1/1974 | Johns | 273/73 F |
| 3,801,099 | 4/1974 | Lair | 273/73 C |
| 3,809,402 | 5/1974 | Haines et al. | 273/73 C |
| 3,913,911 | 10/1975 | Peterson | 273/73 C |
| 3,941,380 | 3/1976 | Lacoste | 273/73 G X |

FOREIGN PATENT DOCUMENTS

| | | | |
|---|---|---|---|
| 848826 | 8/1970 | Canada | 273/73 C |
| 2106800 | 9/1971 | Fed. Rep. of Germany | 273/73 J |
| 132698 | 9/1919 | United Kingdom | 273/73 C |
| 293819 | 7/1928 | United Kingdom | 273/73 C |
| 310566 | 5/1929 | United Kingdom | 273/73 C |
| 381673 | 10/1932 | United Kingdom | 273/73 H |
| 1434741 | 5/1976 | United Kingdom | 273/73 F |

*Primary Examiner*—Richard J. Apley

*Attorney, Agent, or Firm*—Hill, Van Santen, Steadman, Chiara & Simpson

[57] ABSTRACT

A game racket frame such as a tennis racket frame having controlled stiffness properties and light weight making it possible to selectively add weight to the racket at the region in which such weight will do the most good, namely, along the transverse axis of the stringing area. The racket frame itself comprises an integral structure including a head portion, a throat portion and a handle portion, the structure being composed of high modulus fibers such as graphite, glass, boron or the like, in a matrix of a synthetic resin. The frame has a non-uniform cross-sectional configuration and a taper whereby the thickness of the handle portion is greater than the thickness in the head portion, and the thickness of the throat is intermediate that of the handle portion and the head portion. The frame is such as to provide a tapered beam with the greatest area moment of inertia where the bending moments are highest. A tennis racket utilizing the improved frame has an improved coefficient of restitution at high velocity impact, improved ball rebound characteristics for off-center hits and relatively low vibration transmissibility.

18 Claims, 12 Drawing Figures

GAME RACKET

BACKGROUND OF THE INVENTION

1. Field of the Invention

This invention is in the field of game rackets made from high modulus material such as graphite embedded in the matrix of an epoxy resin characterized by providing a smooth transition in stiffness between various portions of the racket. The lack of abrupt changes in stiffness, as are normally present in conventional rackets, for example, produces a better feel in play. The smooth transition of stiffness results in a racket of more uniform strength.

2. Description of the Prior Art

The emphasis in recent years has been the provision of tennis rackets made from metals such as aluminum or steel. Since such metal rackets are commonly formed by extrusion or drawing, the rackets must have a substantially uniform cross-section throughout. This means that for the racket to have a sufficient strength at the handle, the cross-section must be reasonably large. Yet, the large cross-section is neither needed nor desirable at other portions of the racket. The large cross-section, of course, contributes substantially to the weight which means that little, if any, weight can be added where it would do the most good, namely, to increase the mass moment of of inertia of the racket about its longitudinal axis in the stringing plane.

Numerous tennis racket designers have recognized the desirability of positioning weights in an area in which the weights would increase the roll moment of inertia, i.e., the moment of inertia about the longitudinal axis. Typical examples of such disclosures will be found in British Pat. No. 132,698 of 1919; British Pat. No. 310,556 of 1929; and Canadian Pat. No. 848,826. An adjustably positionable set of weights for a tennis racket is disclosed in U.S. Pat. No. 3,913,911.

Still another means for increasing the rotational moment of inertia about the longitudinal axis of the racket is suggested in U.S. Pat. No. 3,801,099 which deals with a racket whose long axis is transverse to the axis of the racket handle.

SUMMARY OF THE INVENTION

The present invention is directed to a game racket having an improved frame of controlled stiffness and light weight. The frame consists of an integral structure including a head portion, a throat portion and a handle portion, the structure being composed entirely of high modulus fibers, such as graphite fibers, in a matrix of a synthetic resin such as an epoxy resin. The frame has a non-uniform cross-section having a maximum height at the butt or handle end of the racket. A substantial portion of the frame handle has a uniform cross-section to facilitate attaching a handle sleeve or the like. The forward part of the handle frame tapers smoothly to the neck portion and the taper is continued through the head area up to 100% but in no event less than 15%, of the longitudinal dimension of the strung area. The untapered area of the head portion has a uniform cross-section.

The head portion is provided with at least one groove along its periphery, and preferably has a groove on each face as well as the marginal peripheral edge. The grooves in the two faces provide a convenient means for attaching weights which are secured to the frame to increase the roll moment of inertia without bringing the weight or balance of the completed racket out of the normally accepted range. The dimensions of the grooves are such that the frame has a substantially constant perimeter at any point along the frame.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

While the structure described herein is applicable to various types of game rackets such as rackets for tennis and racquetball, it finds its most important usage in the field of tennis, and the drawings are directed to this type of structure.

A tennis racket frame of the present invention makes use of a composite-type material composed of high modulus fibers such as graphite fibers, glass fibers, boron fibers, aramid fibers or mixtures thereof in a matrix of an epoxy resin, although the invention is not limited thereto. Such fibers should have a composite specific modulus of elasticity of at least $6\times10^7$ inches. The arrangement is such that there is fiber continuity throughout the entire racket. Preferably, the starting material is a braided tube of graphite fibers in an epoxy resin, the tube being molded by means of pressurizing the interior of the tube in a suitable molding die and heating under pressure until the racket frame is self-sustaining. The reinforcing fibers of the composition are arranged to provide the desired torsional and flexural characteristics for the frame which improve their performance in use, and the tensile and shear strength properties required for product durability. Alternatively, a similar although not as desirable type of product can be made by using graphite tapes which are laid up in a manner commonly used in the manufacture of turbine engine blading, golf shafts, aircraft reinforcing tubes, and the like.

Figure 1:
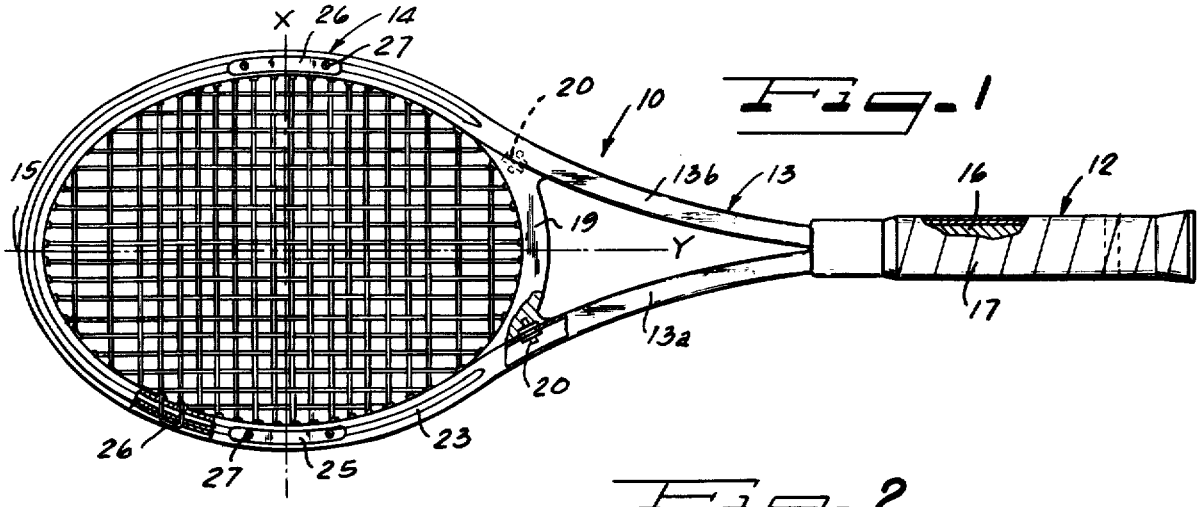
FIG. 1 is a plan view of a completed racket produced according to the present invention.

Turning now to the structural design of the tennis racket frame, in FIG. 1 there is illustrated a complete racket 10 according to the present invention, the racket including a tubular frame composed of an integral structure having opposed leg portions 12a and 12b which together constitute a handle portion 12. The handle is provided with an open throat portion 13 composed of outwardly flared portions 13a and 13b and a generally elliptical head portion generally indicated at reference numeral 14. The head portion 14 terminates in a tip generally indicated at reference numeral 15. The tubular frame structure has an internal volume of at least 200 cc.

Figure 2:
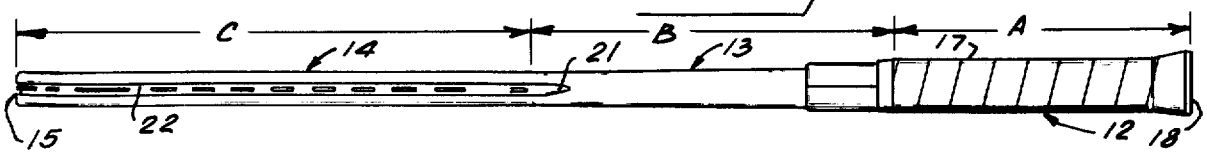
FIG. 2 is a side elevational view of the racket shown in FIG. 1.
Figure 8:
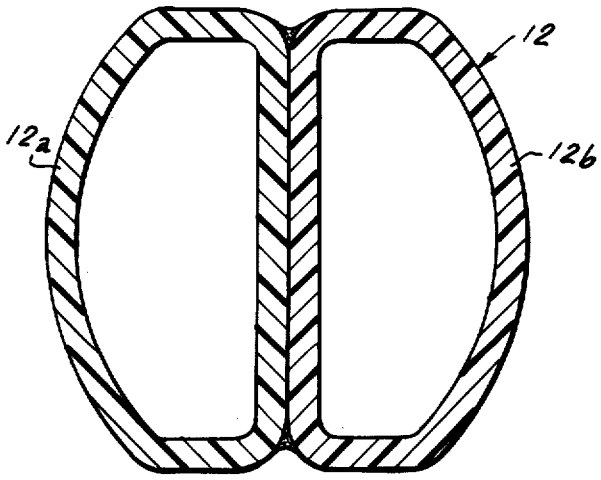
FIG. 8 is an enlarged cross-sectional view taken substantially along the line VIII—VIII of FIG. 4.

The handle portion 12 has a generally uniform height along a substantial portion of its length, that portion being identified in FIG. 2 as dimension A. By "height" we mean the vertical dimension of the particular section when the stringing plane is horizontal, i.e., when the racket is in the position shown in FIG. 2. Along dimension A, the racket of the present invention has its maximum height which is desirable because it provides the greatest area moment of inertia where the bending moments are greatest and therefore improves racket durability. The geometry of the handle section as shown in FIG. 8 thus provides a stiff handle which connects the head of the racket to the player's hand through a variable cross-section beam, rather than relying upon the less desirable and less efficient characteristics of a uniform beam. The handle portions 12a and 12b are covered along their length by means of a low density semiflexible polyurethane foam in the form of a slip-on pallet 16 covered by the usual leather or plastic strip 17 and being provided with a butt cap 18.

As best illustrated in FIG. 2 of the drawings, there is a substantially uniform taper of the racket frame beyond the dimension A, through the flared throat portion and into the head portion 14 as shown by the dimension B in FIG. 2. The taper must extend into the head portion at least 15%, as measured along the long axis of the strung area, but may extend up to 100% of the strung area along the same axis. The remainder of the head portion beyond the taper identified by dimension C in FIGS. 1 and 2 has a substantially constant height. In the drawings dimension C represents the longitudinal dimension of the portion of the head having a constant cross-section. The drawings in FIGS. 1 and 2 show this to be approximately 75% of the total longitudinal axis of the strung area but this dimension may be zero; i.e., the taper can extend to the very tip of the racket.

The wall thickness of the racket frame is substantially uniform throughout. Consequently, the increased height of the handle provides a much stiffer handle portion than exists in, for example, the throat portion which, in turn, is stiffer than the major portion of the head identified at dimension C. By means of the smooth taper, we achieve a smooth change in stiffness and a resultant uniform bending of the frame. This feature of the invention is quite important for the achievement of desirable and preferred playability characteristics. Specifically, extensive play tests with a large variety of rackets has shown that those rackets which exhibit smooth transitions in stiffness provide the players with a better perception of what has actually occurred during ball impact and thereby provide a better "feel". Where previous designs of wooden and metal rackets have attempted to change the stiffness characteristics along the length of the racket, these have invariably resulted in abrupt changes in stiffness, causing non-uniform bending of the frame. Of all rackets previously tested, the racket of this invention has demonstrated improved characteristics of uniform bending over all others.

Figure 9:
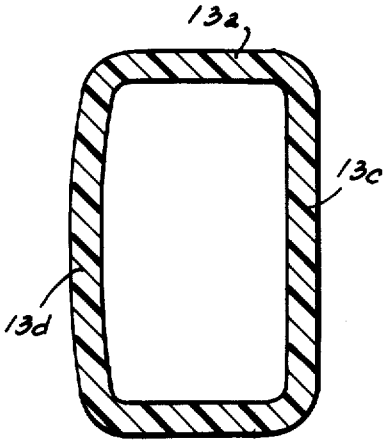
FIG. 9 is an enlarged cross-sectional view taken substantially along the line IX—IX of FIG. 3.

In the throat section 13, the cross-section of the flared arms 13a and 13b has the configuration shown in FIG. 9 of the drawings. It includes a generally straight inwardly facing side 13c and a slightly bowed exterior side 13b. The arms are connected together by means of a yoke 19 secured to the arms by means of fastening means 20. The yoke 19 is composed of a synthetic resin material such as a polycarbonate resin. In a conventional racket using a synthetic resin yoke, the yoke must absorb some of the twisting load on the arms 13a and 13b of the frame. If these arms twist in, the yoke has to bend causing a rolling tendency which causes bending of the yoke. In contrast, the frame of the present invention is so stiff that there is no adverse reaction of the yoke, and the yoke need not share much stress. The cross-sectional configuration is such that the yoke need only absorb tensile and shear loads from the tennis racket strings themselves. Consequently, the yoke 19 need not be as heavy as yokes commonly used, thereby providing still another saving in weight.

The head portion 14 is provided with one or more grooves such as a peripheral groove 21 which commences in a region of the yoke 19, as shown in FIG. 2. In this groove 21 there is positioned a grommet strip 22 (FIG. 1). Because of the stiffness of the racket frame, the grommet strip 22 must provide a cushioning effect to the string, the cushioning serving to assist in damping vibrations due to off-center hits and not transmitted to the arm of the player. As a grommet strip, we prefer to use an injection molded urethane elastomer having a Durometer reading of 65–75 on the Shore D scale. Conventional grommet strips for rackets are usually in the range of 85 to 100 on the Shore D scale.

Figure 5:
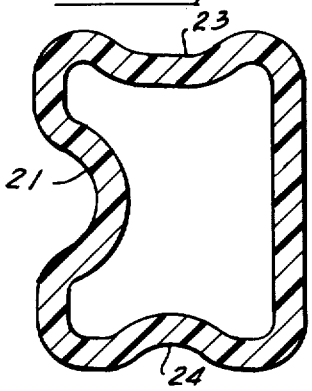
FIG. 5 is an enlarged cross-sectional view taken substantially along the line V—V of FIG. 4.
Figure 6:
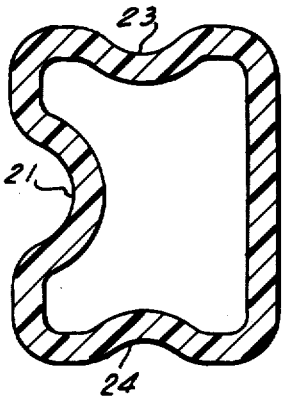
FIG. 6 is an enlarged cross-sectional view taken substantially along the line VI—VI of FIG. 3.
Figure 7:
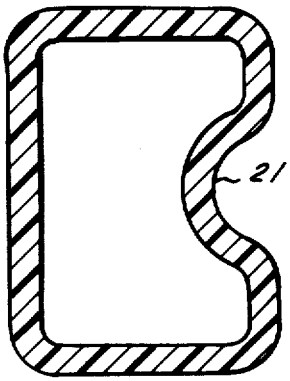
FIG. 7 is an enlarged cross-sectional view taken substantially along the line VII—VII of FIG. 3.

The head portion 14 also has a pair of opposed grooves 23 and 24 as best illustrated in FIG. 5. These grooves also commence in the region of the yoke 19 as illustrated in FIG. 1. At the transverse axis of the racket, axis X, the grooves 23 and 24 are widened as illustrated at 23a and 23b in FIG. 3 to accommodate a pair of weights 25 and 26 on each side of the racket as shown in FIG. 1. Similar weights (not shown) are provided on the opposed surface which contains grooves 24. The weights 25 and 26 may be adhesively secured to the frame or they may be secured by means of screws 27 or other mechanical fasteners.

Figure 3:
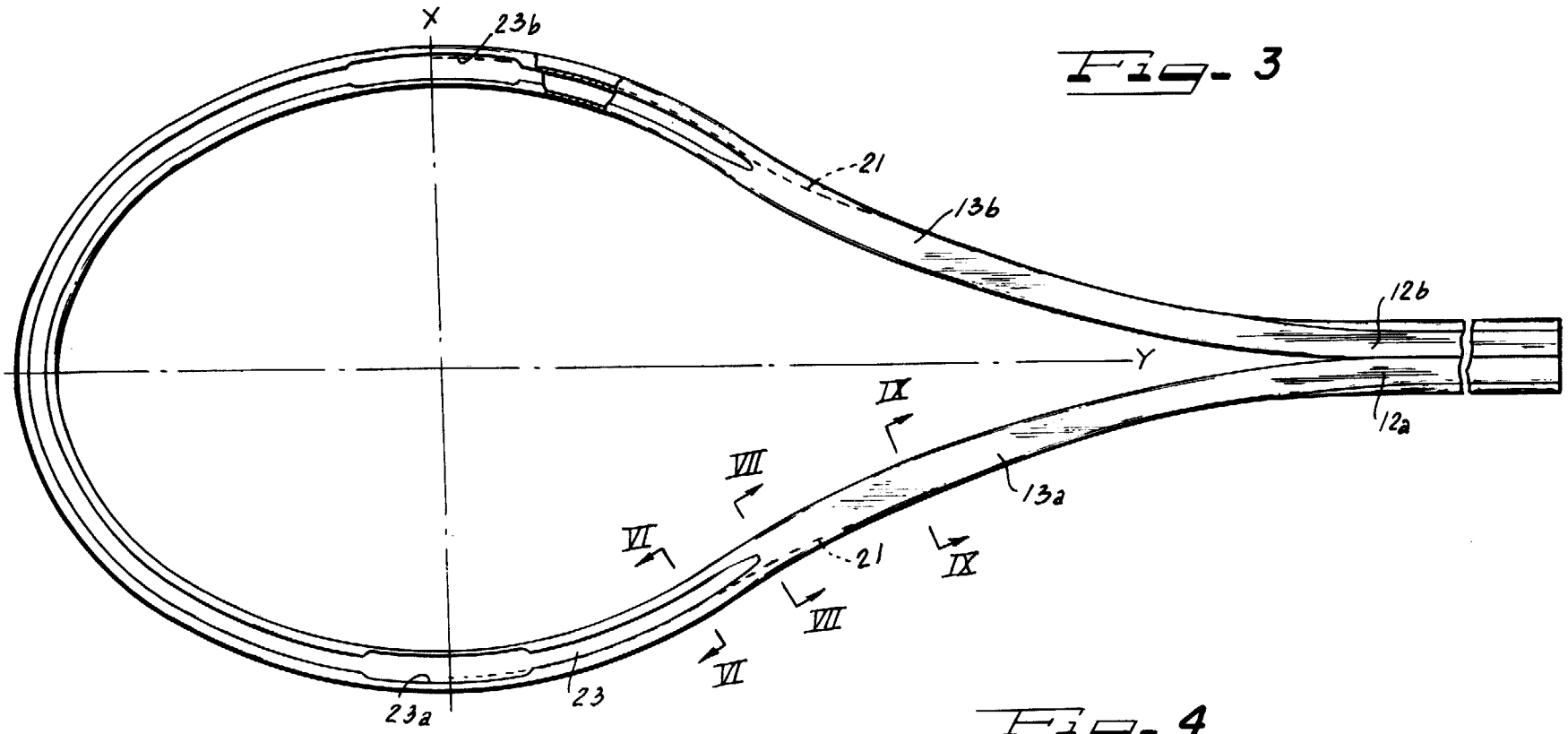
FIG. 3 is a plan view of a bare racket frame produced according to the present invention.
Figure 4:
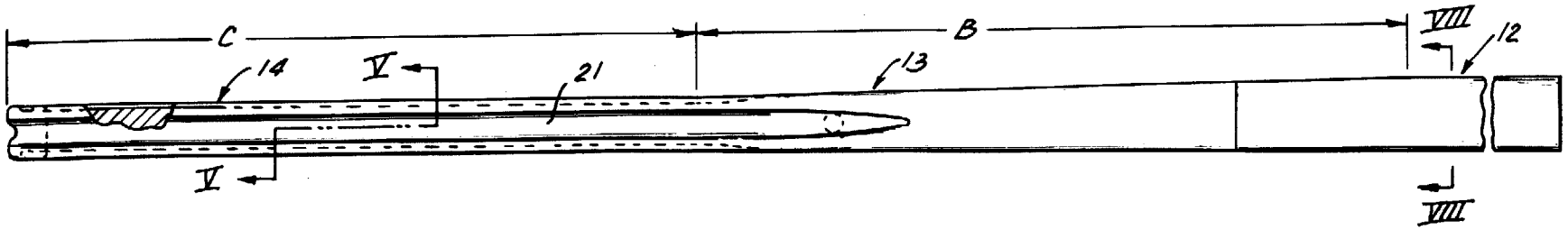
FIG. 4 is a side elevational view of the frame shown in FIG. 3.

In the raw state of the frame illustrated in FIG. 3, the frame weighs on the order of 195 grams. In contrast, a raw steel frame weighs from 225 to 230 grams, and the commonly used aluminum frame weighs about 240 to 250 grams. Consequently, by achieving a stiff, strong and lightweight frame, the present invention provides the capability of selectively adding more than ½ oz. (14.2 g) of weight at the most desirable position along the axis as illustrated in FIG. 1, thereby increasing the mass moment of inertia of the racket about the longitudinal axis Y, shown in FIG. 1 while still providing a strung racket whose weight is not more than 14 oz. (396 g), and still has a conventional balance point at 46 to 52% of the racket length measured from the butt end. The mass moment of inertia of the strung racket about its longitudinal centerline lies in the range from 63 to 80 .oz-in$^2$.

The ability of the frame of the present invention to permit selective application of weights and thereby increase the mass moment of inertia provides the player with numerous and significant performance advantages, including increased resistance to off-center hits thereby contributing to improved ball control. The ability to be able to concentrate weight on the transverse axis also leads to more power and better stroke follow-through.

The depth of the grooves 21, 23 and 24, as well as their extent is such that the frame has a constant perimeter throughout its length. In other words, the perimeter in the handle section as shown in FIG. 9 is substantially the same in the head section as illustrated in FIG. 5. The grooves therefore permit molding of the substantially inextensible material into a smaller cross-sectional area in the head than in the handle.

We have compared the stiffness of rackets produced according to the present invention with commercially available rackets of various description. The static stiffness was determined by clamping the bottom six inches of the racket and then applying a 3 kilogram load at the tip. The bending stiffness measured in this manner for the new racket ranged from 0.100 to 0.200 inch (0.254 to 0.508 centimeters). A specific comparison between the racket of the present invention reinforced with graphite and several commercial rackets is given in the following table. The rackets identified as "A" and "B" are commercial graphite reinforced tennis rackets. Racket "C" had a frame consisting of a braided graphite tube. Racket "D" had a frame composed of a syntactic foam composite with aluminum facings. Racket "E" was a popular wooden racket, and racket "F" was a boron reinforced wooden racket having an open throat. The "raw frame weight" is the weight of the unstrung frame, less handle, plus whatever yoke structure is used for supporting the strings.

| | Bending stiffness, in. | Raw frame weight, oz. |
|---|---|---|
| New racket | 0.138 | 8.11 |
| Racket "A" | 0.270 | 8.93 |
| Racket "B" | 0.225 | 9.63 |
| Racket "C" | 0.306 | 9.29 |
| Racket "D" | 0.336 | 10.13 |
| Racket "E" | 0.362 | 12.25 |
| Racket "F" | 0.300 | 11.78 |

The new racket thus has a substantially greater bending stiffness (61% stiffer than the next stiffest commercial racket tested), even with a significant reduction in weight. With this stiff a racket, a ball hit anywhere along the hitting area will not tend to deflect the racket as much as the other commercial rackets tested, and the ball is more likely to go in the direction in which the racket is pointed, and with greater ball speed. This is particularly important near the top of the racket where deflection is greatest.

We also compared the torsional stiffness of the new racket with the rackets described above. Torsional stiffness was determined by applying a 3 kilogram load on a 10 inch moment arm while the racket was clamped at its bottom six inches, and measuring the angle of twist. The twist of the new racket according to the present invention measured from 0.0180 to 0.032 radians. The corresponding measurements on the other rackets are given in the following table.

| | Angle of twist, radians |
|---|---|
| New racket | 0.0244 |
| Racket "A" | 0.0503 |
| Racket "B" | 0.0358 |
| Racket "C" | 0.0398 |
| Racket "D" | 0.0409 |
| Racket "E" | 0.0500 |
| Racket "F" | 0.0460 |

Surprisingly, the torsional stiffness of the new racket was not measurably different with or without a yoke being present. This is made possible by the unique characteristics of the frame structure such that the function of the yoke in our new racket is merely to tie the two sections of the throat together, and to serve as an anchoring point for strings.

The torsional stiffness of the new racket comes from the orientation of the fibers and the flared, open throat design which gives it more torsional stability, and a higher polar moment of inertia. This torsional stiffness contributes to the increased player control inherent in this racket design.

We also determined the mass moments of inertia of the rackets about the axis indicated as "Y" in FIG. 1, i.e., the longitudinal axis. All of the data were collected for standard medium weight rackets. The units are oz. in$^2$.

| | Iy, (oz.in.$^2$) |
|---|---|
| New racket | 75.80 |
| Racket "A" | 58.50 |
| Racket "B" | 56.40 |
| Racket "D" | 61.70 |
| Racket "E" | 57.40 |
| Racket "F" | 59.14 |

Throughtout the text of this patent we make reference to mass moment of inertia. The conventional units of measure for mass moment of inertia are lb-ft-sec$^2$. Because of the manner in which inertia was measured on the rackets and the subsequent use of those values as related to racket design, a more convenient way of expressing inertia in units of "oz in$^2$" was utilized.

EXAMPLE

A racket whose mass moment of inertia defined herein as 80 oz in$^2$ would be expressed in more conventional units as:

$$\text{Mass moment of inertia} = \frac{80\ \text{oz in}^2}{386\ \text{in/sec}^2} \times \frac{1\ \text{lb}}{16\ \text{oz}} \times \frac{1\ \text{ft}}{12\ \text{in}}$$

$$= 0.001079\ \text{lb-ft-sec}^2$$

where 386 in/sec$^2$ is the acceleration due to gravity.

The relatively high mass moment of inertia about the longitudinal axis possessed by the racket of the present invention reduces the tendency of the racket to be deflected or twisted in the player's hand on off-center hits.

An additional and unexpected advantage possessed by the rackets of the present invention is concerned with the manner in which they bend. It is known that rackets vibrate in a free, free mode. Rackets of the present invention, upon impact, vibrate to provide antinodes at each end and one near the center of the frame, and two nodes, each of which is located about ¼ of the way in from each end. This, therefore, places one of the bending nodes at the geometric center of the strings, which is different from other rackets where the bending node in the head area falls below the geometric center of the strings. Consequently, balls hit in the geometric center of the strings create substantially less amplitude of vibration at the fundamental frequency of the frame resulting in less overall vibration, better transmissability (less masking) of higher frequency ball and string vibrations, and less deflection in the racket. These characteristics contribute to added ball velocity (thru less energy absorption in the racket) as well as improved player feel.

Figure 10:
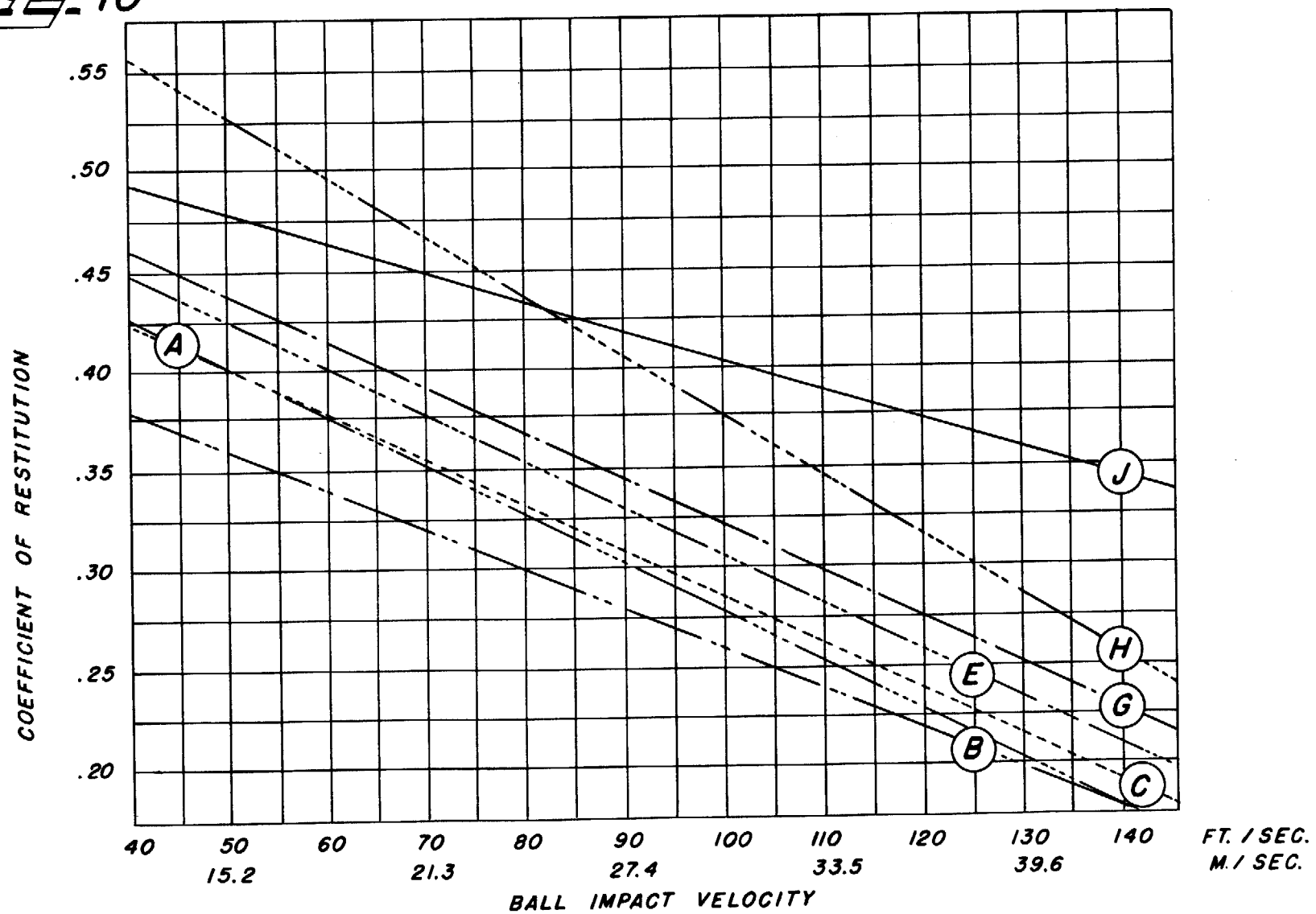
FIG. 10 is a graph plotting coefficient of restitution against ball impact velocity for various rackets.
Figure 11:
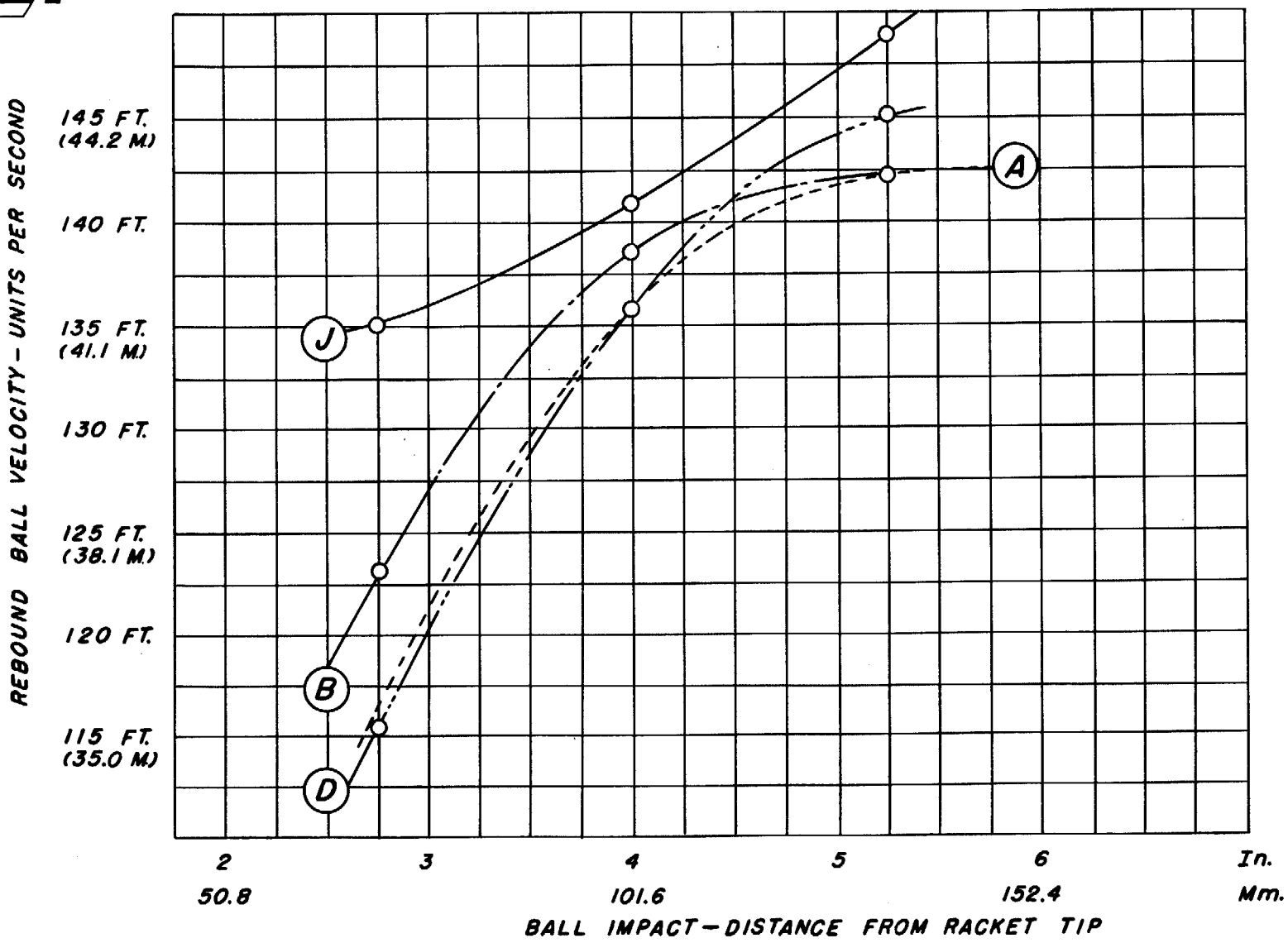
FIG. 11 is a graph plotting rebound ball velocity against ball impact point for various rackets.
Figure 12:
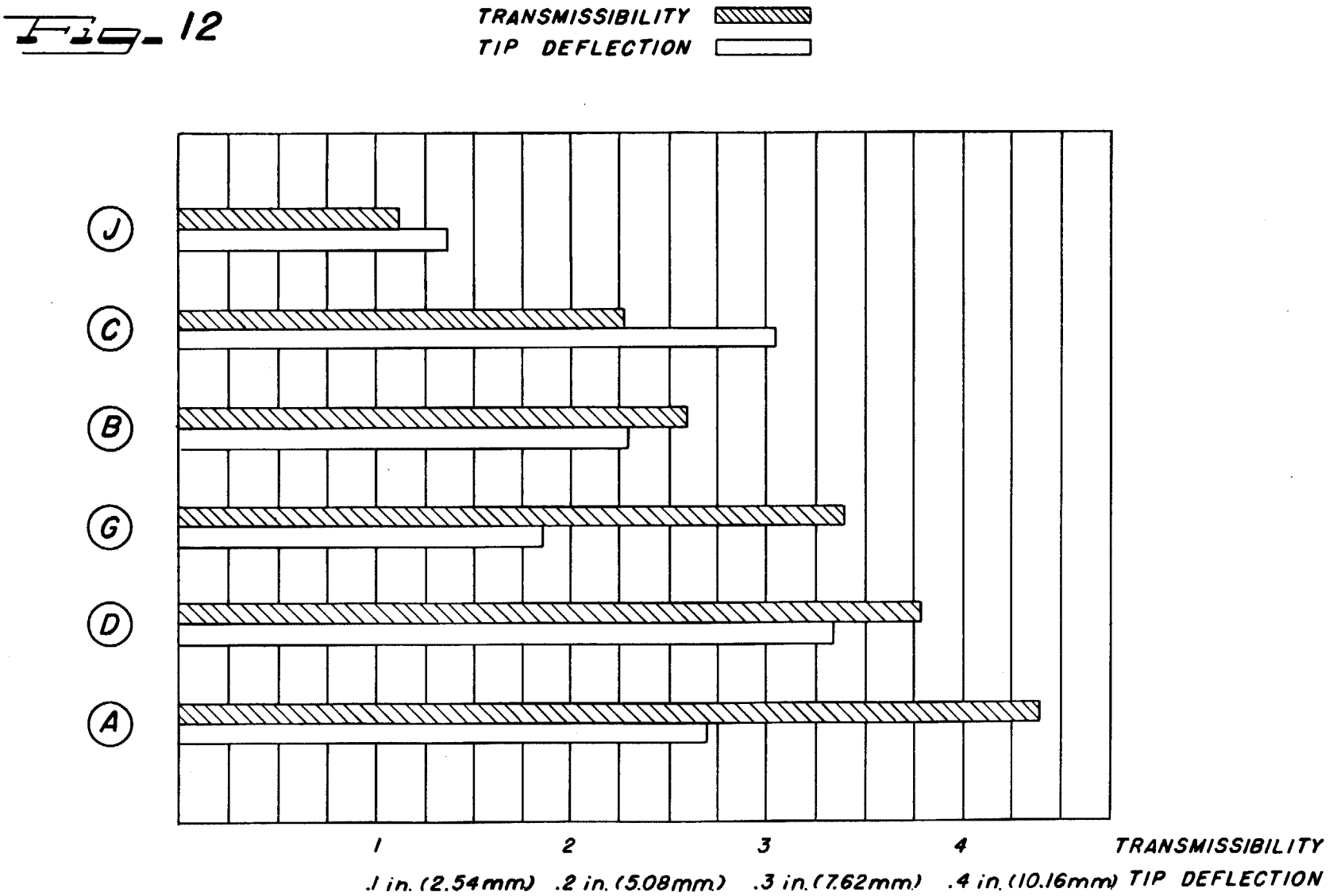
FIG. 12 is a graph plotting transmissibility and tip deflection for various rackets.

The graphs of FIGS. 10 through 12, inclusive, represent additional test results comparing the improved rackets of the present invention with commercially available rackets and serve to further underscore the benefits achieved by the unique features found in the present invention. In addition to the rackets identified previously, tests were made using racket "G" which is a commercially available graphite racket, racket "H" which is a commercially available oversized aluminum racket, and racket "J" which is a racket produced according to the present invention and consisting of a tubular frame of a graphite tube reinforced epoxy resin matrix. All of the rackets under test weighed between 12 and 13 ounces and had strings of identical materials and string tensions.

In the coefficient of restitution test set forth in FIG. 10 of the drawings, the racket was clamped at the handle and tennis balls were fired at it from between rotating wheels. The velocity of the ball was measured just before impact and just after impact. From the graph set forth in FIG. 10, it will be noted that the racket of the present invention, racket "J" had a more nearly constant coefficient of restitution for the wide range of ball impact velocities than any of the other rackets. Furthermore, it exhibited the highest coefficient of restitution at higher impact velocities of 80 feet/sec. (24.36 meters/sec) and more. This is where the coefficient of restitution becomes most important since most strokes (ground and service) occur at a speed of 100 to 150 ft. per sec. Therefore, for a given racket velocity, a higher ball velocity is achieved than with conventional rackets. Since higher return velocities are possible, a lower input effort is required and hence fatigue is reduced while power is maintained.

The tests graphically illustrated in FIG. 11 of the drawings were done on a machine known as a "Whacker." This machine utilizes two tennis rackets positioned 180° apart on a rotating arm. The arm is rotated to simulate the service condition. A ball drops from a chute and is impacted by the racket at about 90 miles per hour (132 ft/sec)./(144.9 km/hr.). As noted in the graph of FIG. 11, the balls were impacted at three points, 2.75 inches (6.99 cm.) from the racket tip, the second being 4.0 inches (10.16 cm.) from the tip, and the third being 5.25 inches (13.34 cm.) from the tip, and being about at the geometric center of the strung area. The racket produced according to the present invention, racket "J" exhibits better rebound characteristics on all types of hits, and particularly on above center hits. Overall, therefore, the player can secure more velocity on return with a constant swing velocity using the rackets of the present invention.

The transmissibility characteristics and the bending tip deflection data for various rackets are given in FIG. 12. As noted, the tip deflection was measured by applying a 3 kilogram static load at the tip of the racket.

The transmissibility which is the ratio of dynamic load output to dynamic load input is a measure of the shock transmission characteristics of the racket. In performing these tests, the racket was hung from its nodes with low spring rate elastomers. A shaker mechanism was attached to the geometric center of the strung area to provide a dynamic input of 5 g. An accelerometer was mounted at the butt end of the racket. The shaker mechanism was swept through frequencies of 80 to 500 Hertz in a period of about 17 seconds. The low frequency limit of 80 Hertz is above the fundamental frequency of the strings (50 to 70 Hertz) to prevent string breakage but includes all of the significant natural resonant frequencies of the frame which occur in play. The peak acceleration which occurs as the frame is going through mechanical resonance was measured in each instance and the transmissibility was the measured acceleration divided by the input, 5 g. As noted from FIG. 12, the racket of the present invention had the lowest overall transmissibility of any racket. Even more surprising, however, is the fact that this low transmissibility is coupled with the lowest tip deflection so that despite the high stiffness of the racket, not as much of the frame vibration is transmitted to the handle as in other rackets.

The variable cross-section, tapered beam open throat configuration of the racket of the present invention provides the desired torsional and flexural characteristics for improved playing performance, and the tensile and shear strength properties for durability. It provides the maximum cross-section moment of inertia where the bending moments are greatest, namely, in the handle and a reduced stiffness at the tip of the racket where the bending moments are minimal. The variation in stiffness is relatively smooth from the butt to the tip of the racket, thereby improving the "feel" of the racket during play. What is more, the racket is sufficiently stiff so that there is no adverse reaction on the yoke, and the yoke does not have to face any extraordinary orthogonal bending loads. The significant reductions in weight which are possible through the improved geometry of the frame make it possible to add back a significant amount of weight where it will do the most good, namely, spaced from the longitudinal axis of the racket so that the mass moment of inertia is increased about this axis, and the racket is better able to handle off-center hits. In addition, this concentration of weight spaced from the longitudinal axis of the racket also acts to further increase ball rebound, or power, for a given amount of racket swing velocity and it permits the easier completion or follow-through of the stroke.

One additional benefit from the geometry of the present invention is that its taller cross-section provides less width to the racket, thereby decreasing the air resistance and providing less aerodynamic drag, further allowing greater racket speeds.

It will be evident that various modifications can be made to the described embodiments without departing from the scope of the present invention.

We claim as our invention:

1. A game racket frame of controlled stiffness properties composed of an integral structure of high modulus fibers in a matrix of a synthetic resin, said fibers having a specific modulus of elasticity of at least $6\times10^7$ inches, said integral structure being of substantially uniform wall thickness throughout, and including a rounded open head portion, an open throat portion forming a continuation of said head portion and a handle portion terminating said throat portion, said handle portion having a generally uniform height greater than the height of the remainder of said frame and having the greatest moment of inertia of any portion of said frame, said handle being composed of two mating portions each of which is non-symmetrical with respect to a vertical plane passing through its center, said frame having a substantially uniform taper extending from the inward end of said handle portion into and through said throat portion, thereby providing a smooth decrease in stiffness in said throat portion from said handle portion to said head portion, said smooth taper extending into said head portion to an extent of at least 15% of the long axis of the open head portion, said throat also having a non-symmetrical cross section with respect to a vertical plane passing through its center, said frame providing the characteristics of a variable cross section beam.

2. A racket frame according to claim 1 in which both said handle portion and head portion have portions of uniform height.

3. A racket frame according to claim 1 wherein said head portion has at least one groove along its periphery, the dimensions of the groove being such that the frame has a substantially constant perimeter at any point along the frame.

4. A tennis racket of improved stiffness characteristics comprising an integral frame structure composed of high modulus fibers in a matrix of a synthetic resin, said fibers having a specific modulus of elasticity of at least $6\times10^7$ inches, said integral structure having a substantially uniform wall thickness throughout, including a generally elliptical head portion, an open throat portion forming a continuation of said head portion and a handle portion terminating said throat portion, longitudinally and transversely extending strings extending across said head portion, said handle portion having a generally uniform height greater than the height of the remainder of said frame and having the greatest moment of inertia of any portion of said frame, said handle being composed of two mating portions each of which is non-symmetrical with respect to a vertical plane passing through its center, said frame having a substantially uniform taper extending from the inward end of said handle portion into and through said throat portion, thereby providing a smooth decrease in stiffness in said throat portion from said handle portion to said head portion, said smooth taper extending into said head portion to an extent of at least 15% of the long axis of the open head portion, said throat also having a non-symmetrical cross section, a yoke connecting together opposed portions of said throat portion, and a weighting means secured to said head portion to increase the moment of inertia along the longitudinal centerline of the racket.

5. A racket according to claim 4 which has a bending stiffness of from 0.100 to 0.200 in. (0.254 to 0.508 cm.) as measured by applying a 3 kilogram load at the tip of the racket with the bottom six inches of the racket clamped.

6. A racket according to claim 4 having a torsional stiffness of 0.018 to 0.032 radians as measured by applying a 3 kilogram torsional load on a 10 inch arm at the tip of the racket with the bottom six inches of the racket clamped.

7. The racket of claim 4 in which the total mass of the weighting means is greater than 0.5 oz. (14.2 g.), and weight of the strung racket is not in excess of 14 oz. (396 g.), and the balance point being located at a point 46 to 52% of the length of the racket measured from the butt end.

8. The racket of claim 4 in which said head portion has a continuous peripheral groove for receiving strings therein, and grooves on both racket faces in which said weighting means are received.

9. The racket of claim 4 in which the mass moment of inertia about the longitudinal axis is at least 63 oz. -in$^2$.

10. The racket of claim 4 in which said frame structure consists of graphite fibers, glass fibers, aramid fibers or boron fibers or mixtures thereof in an epoxy resin matrix.

11. The racket of claim 4 in which one of the fundamental free-free bending nodes of the racket substantially coincides with the geometric center of the strings.

12. The racket of claim 4 in which said frame structure has an internal volume of at least 200 cc.

13. The racket of claim 4 in which said head portion contains a continuous peripheral groove in which there is a cushioned grommet strip.

14. The racket of claim 4 in which said handle includes a semi-flexible foamed resin pallet surrounding said frame handle portion.

15. The racket of claim 4 in which said head portion includes a continuous peripheral groove and a pair of grooves on its opposed faces, the dimensions of the grooves being such that the perimeter of the racket in the head portion is substantially the same as the perimeter of the handle portion.

16. The racket of claim 4 in which the taper in the head portion extends up from 15 to 100% of the longitudinal axis of the strung area.

17. The racket of claim 4 in which said high modulus fibers in said synthetic resin matrix are in the form of a braided construction.

18. The racket of claim 4 in which the first node of vibration of the racket in its fundamental free-free node is located coincident with the center of the hitting area along the longitudinal axis.

* * * * *